US006296885B1

(12) United States Patent
Robertson

(10) Patent No.: US 6,296,885 B1
(45) Date of Patent: Oct. 2, 2001

(54) PROCESS FOR PREPARING AND USING A LAYERED FOOD PREPARATION PRODUCT

(76) Inventor: Linda L. Robertson, 4306 Glen Eagle Dr., Columbia, MO (US) 65203

( * ) Notice: Subject to any disclaimer, the term of this patent is extended or adjusted under 35 U.S.C. 154(b) by 0 days.

(21) Appl. No.: 09/515,772

(22) Filed: Feb. 29, 2000

(51) Int. Cl.[7] ..... B65D 23/00; B65D 25/04

(52) U.S. Cl. ..... 426/115; 426/119; 426/120; 426/394; 426/398

(58) Field of Search ..... 426/112, 115, 426/119, 120, 124, 128, 392, 394, 398; 215/6

(56) References Cited

U.S. PATENT DOCUMENTS

| | | | | |
|---|---|---|---|---|
| Re. 18,426 | * | 4/1932 | Willoughby | 426/8 |
| 1,186,391 | * | 6/1916 | Gary | 426/108 |
| 1,861,124 | * | 5/1932 | Lorber | 426/119 |
| 1,904,741 | * | 4/1933 | Lorber | 426/395 |
| 3,236,369 | * | 2/1966 | Moore | 206/205 |
| 4,820,533 | * | 4/1989 | Seaborne et al. | 426/76 |
| 4,874,618 | * | 10/1989 | Seaborne et al. | 426/76 |

* cited by examiner

*Primary Examiner*—Nina Bhat
(74) *Attorney, Agent, or Firm*—Dale J. Ream

(57) ABSTRACT

A process for sequentially filling a container with layers of dry food ingredients in reverse order relative to a desired order of removal for the preparation of a final food product. A first dry food ingredient is deposited into a container. A disk-like divider is positioned atop the deposited food ingredient and depressed such that a flat and level surface is formed atop the food ingredient and the periphery of the divider frictionally adheres to the side wall of the container to seal the food ingredient from a next food ingredient. A next food ingredient is then deposited into the container atop the previously positioned divider. A divider is positioned atop the next food ingredient, and so on until all of the dry ingredients according to a recipe have been introduced into the container. The food ingredients are removed in the reverse order in which they were deposited and selectively combined with wet ingredients according to a recipe for preparation of a final food product. Only the uppermost ingredient can be removed until the next adjacent divider is removed from the container.

4 Claims, 6 Drawing Sheets

PROCESS FOR PREPARING AND USING A LAYERED FOOD PREPARATION PRODUCT

BACKGROUND OF THE INVENTION

The present invention relates generally to a process for food preparation and, more particularly, to a process for filling a container with multiple layers of dry food ingredients and using said container of ingredients in the preparation of a final food product.

Preparation of dessert type food products typically involves the mixing of specific quantities of multiple dry food ingredients with other wet ingredients. Typical dry food ingredients include flour, sugar, salt, baking soda, etc., and wet ingredients may include eggs, milk, vanilla, and butter. Entire packages of these ingredients must be purchased even if only a very small amount is needed according to a selected recipe. Further, the one preparing the food product must be cognizant of the correct order in which to mix the ingredients for optimal results.

Therefore, it is desirable to have a commercial process for filling containers with predetermined amounts of dry food ingredients, each of which containers can be used in preparing a food product according to a selected recipe. Further, it is desirable to have a process in which layers of dry food ingredients within the container are kept separated from one another. In addition, the layers of dry food ingredients should be organized in reverse order relative to the order in which they will be needed during preparation of the food product. Finally, it is desirable to have a process in which only a single food ingredient is removed when a container of layered ingredients is inverted until a divider is removed.

SUMMARY OF THE INVENTION

Accordingly, the process according to the present invention includes providing a cylindrical container having an open top for providing access to the interior thereof. According to a recipe of ingredients needed for preparation of a food product, a plurality of dry ingredients are sequentially deposited into the container. The dry ingredients are deposited in reverse order relative to a predetermined order in which the ingredients need to be removed during preparation of the food product. For example, the first dry ingredient deposited into the container is the last dry ingredient called for in the recipe.

The deposition of each respective ingredient into the container is followed by the insertion of a divider into the interior of the container and positioned atop a respective ingredient. Insertion of a divider is made prior to depositing a next ingredient into the container such that a previous food ingredient remains separated and unmixed with the next ingredient. Each divider is flexible enough to be inserted through the open top of the container and then flattened atop the food ingredient therein. Pressure is placed on a divider either by a user's fingers, a special tool or utensil, or merely by the weight of the next ingredient being deposited into the container. As pressure is applied, a respective divider causes the food ingredient immediately therebelow to form a level top surface. Further, the peripheral edges of the divider are pressed against the inner surface of the container side wall and become frictionally adhered thereto.

When a user is ready to actually prepare the final food product, the dry ingredients are sequentially removed from the container in the reverse order in which they were deposited. When the container is inverted, the uppermost ingredient (last to be deposited) is poured out through the open top. The other ingredients are held in the container by respective frictionally adhered dividers. The container is then returned to an upright position. The uppermost divider may then be removed by piercing the divider with a sharp instrument, such as a fork, and then lifting it through the open top. The steps of inverting the container, returning it to an upright position, and removing a divider are repeated until all desired food ingredients have been removed. The dry ingredients may be mixed together or combined with wet ingredients as called for by the recipe, including mixing some of the dry ingredients with wet ingredients prior to removing all of the dry ingredients from the container. Some ingredients, e.g. salt or sugar, may be omitted in whole or in part, as desired.

Therefore, a general object of this invention is to provide a process for filling a container with dry ingredients for use in preparing a final food product.

Another object of this invention is to provide a process, as aforesaid, in which each of the dry ingredients are maintained in separated layers within the container.

Still another object of this invention is to provide a process, as aforesaid, in which the dry ingredients are sequentially deposited into a container in the reverse order relative to a predetermined order of removal.

Yet another object of this invention is to provide a process, as aforesaid, in which a divider is positioned between each dry ingredient layer to keep adjacent layers separate from one another and to hold layers, other than the uppermost layer, within the container when the container is inverted.

A further object of this invention is to provide a process, as aforesaid, in which the container used for holding the dry ingredients is constructed of a non-breakable and transparent material.

A still further object of this invention is to provide a process, as aforesaid, in which separation and sealing of the dry ingredients within the container increases the shelf life thereof.

Another object of this invention is to provide a process, as aforesaid, in which the dry ingredients within the container can be selectively combined with wet ingredients according to a recipe for preparation of a final food product.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
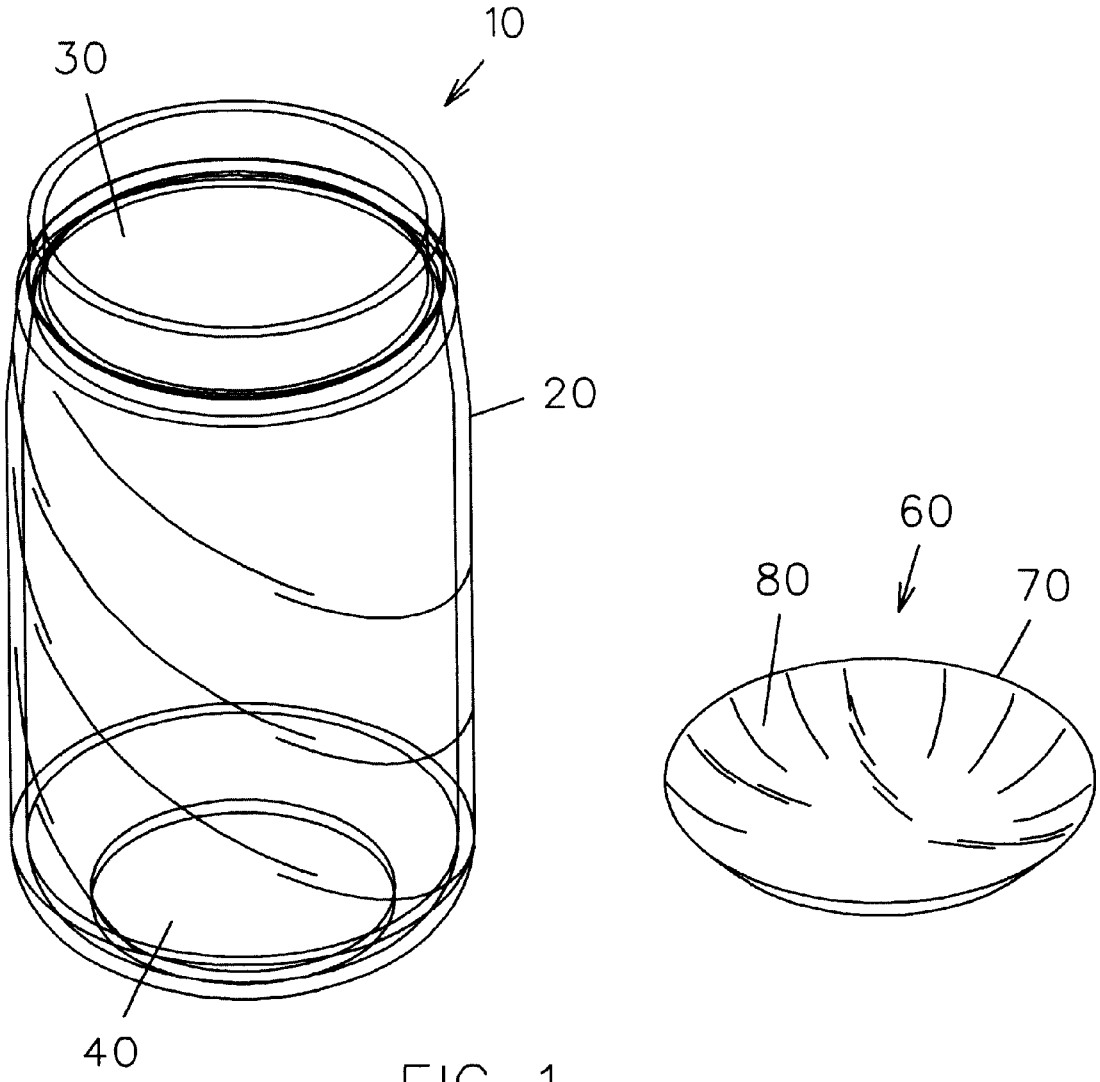
FIG. 1 is a perspective view of a container and divider according to a preferred embodiment of the invention.

The preferred embodiment of the present invention will now be described with reference to FIGS. 1–6. The process according to the present invention involves introducing a plurality of dry food ingredients into a transparent, cylindrical container 10 having a side wall 20, a closed bottom 40, and an open top 30. Preferably, the container 10 is constructed of a non-breakable transparent material such as polycarbonate and configured like a conventional mason jar (FIG. 1) although containers having other configurations would also be suitable. The container 10 includes a lid 50 threadably coupled to a neck portion of the jar (FIG. 5) and, therefore, selectably releasable therefrom. A doily may be added between the lid 50 and the open top 30 for added aesthetic appeal or to be associated with a particular recipe.

Figure 2:
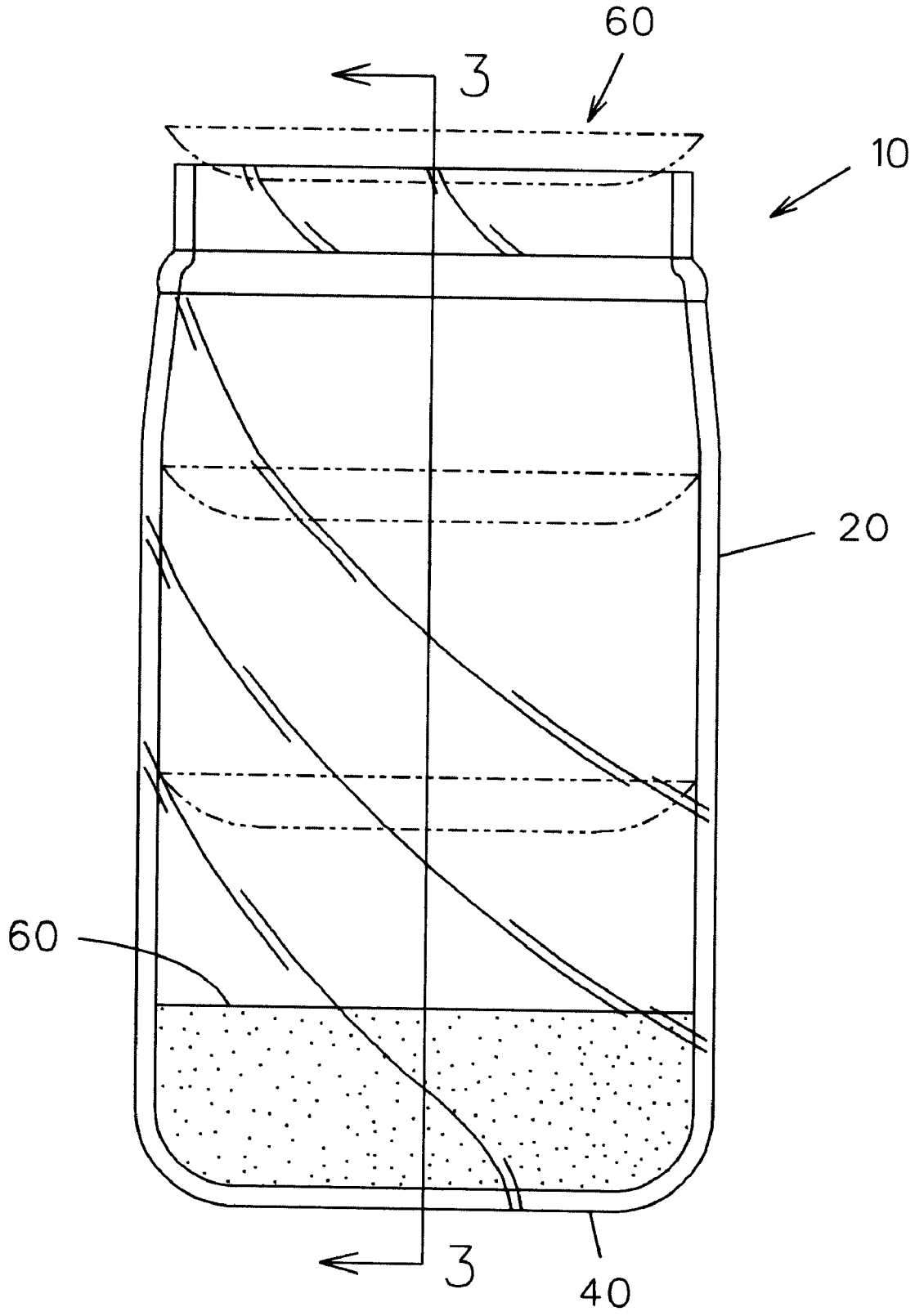
FIG. 2 is a front view of the container as in FIG. 1 showing insertion of a divider therein.
Figure 3:
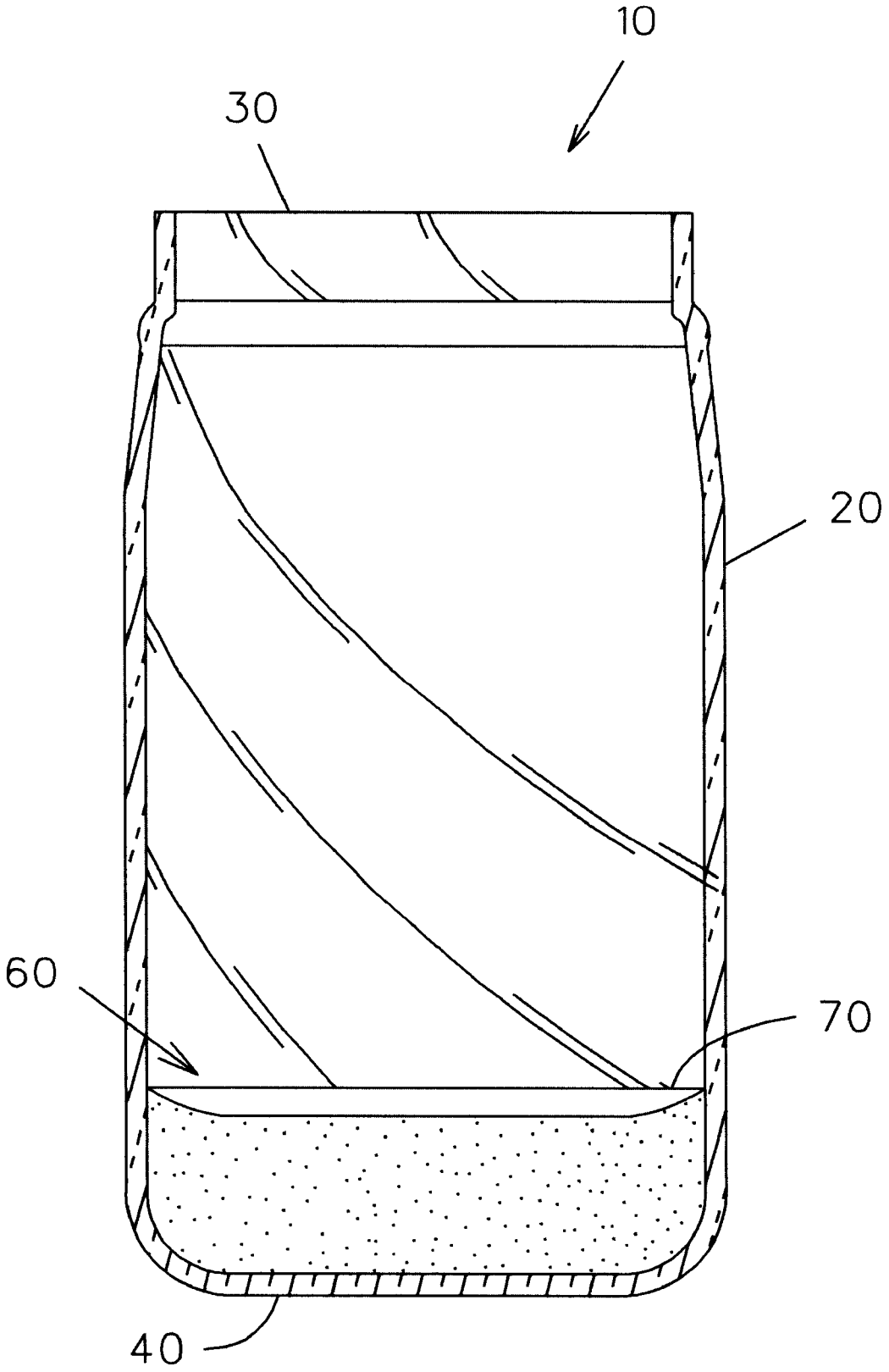
FIG. 3 is a sectional view of the container taken along line 3—3 of FIG. 2.
Figure 4:
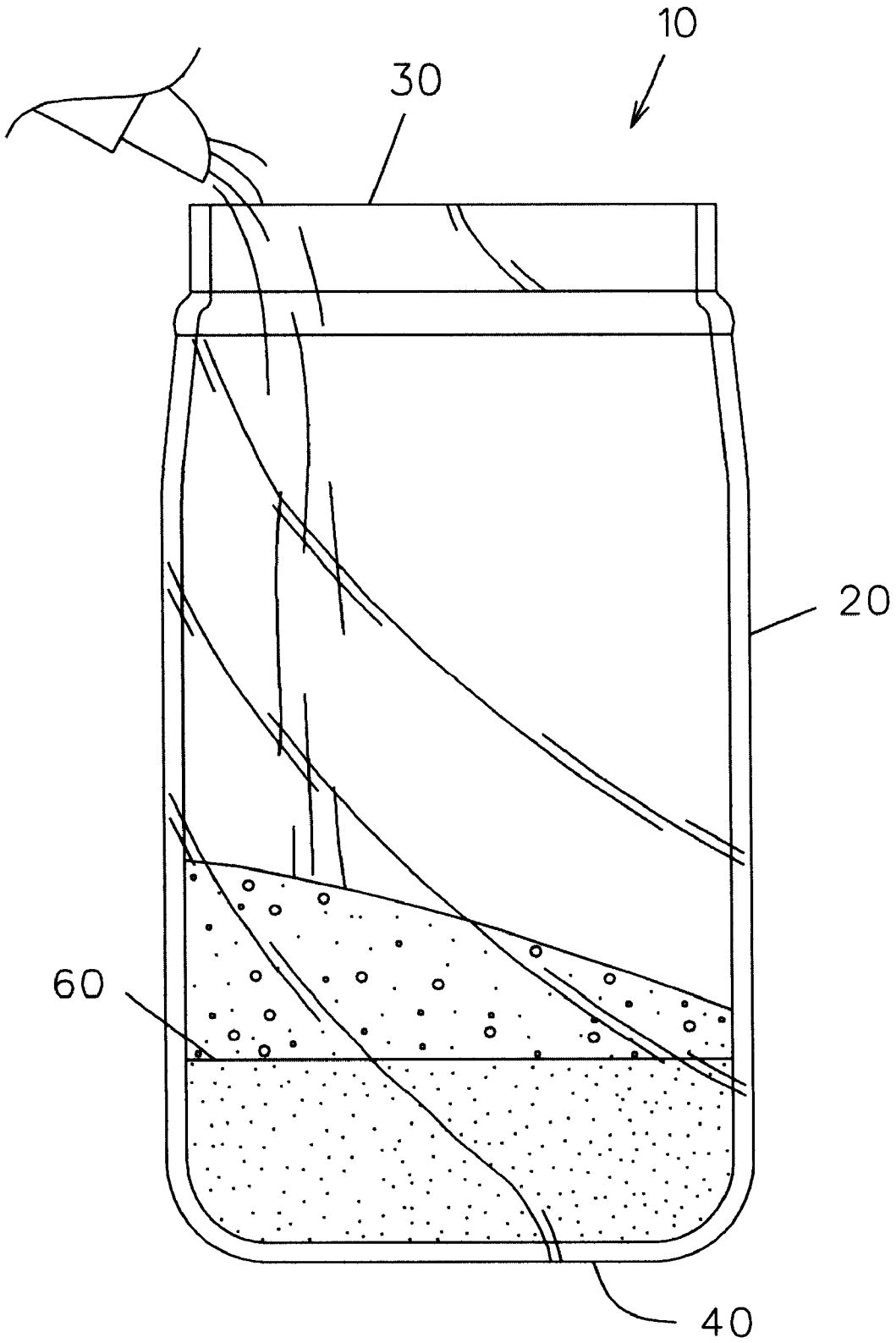
FIG. 4 is a front view of the container showing the introduction of a second food ingredient.

A plurality of dry food ingredients, such as flour, sugar, salt, baking soda, etc., are sequentially deposited into the container 10 in the reverse order relative to a predetermined order of removal. However, after each distinct ingredient is deposited in the container 10, a disk-like divider 60 is inserted through the open top 30 of the container 10 and positioned atop the previously deposited dry food ingredient (FIG. 2). Each divider 60 is constructed of a semi-flexible, transparent material and presents a concave configuration. Each divider 60 is positioned within the container 10 such that its peripheral edges 70 extend upwardly. A plurality of pleats 80 or flutes extend radially about a top surface of each divider 60 such that the divider 60 can be inwardly collapsed while inserting the divider 60 through the open top 30 of the container 10. This is necessary as each divider 60 has a diameter slightly larger than a diameter of the open top 30 and of the side wall of the container 10.

Figure 5:
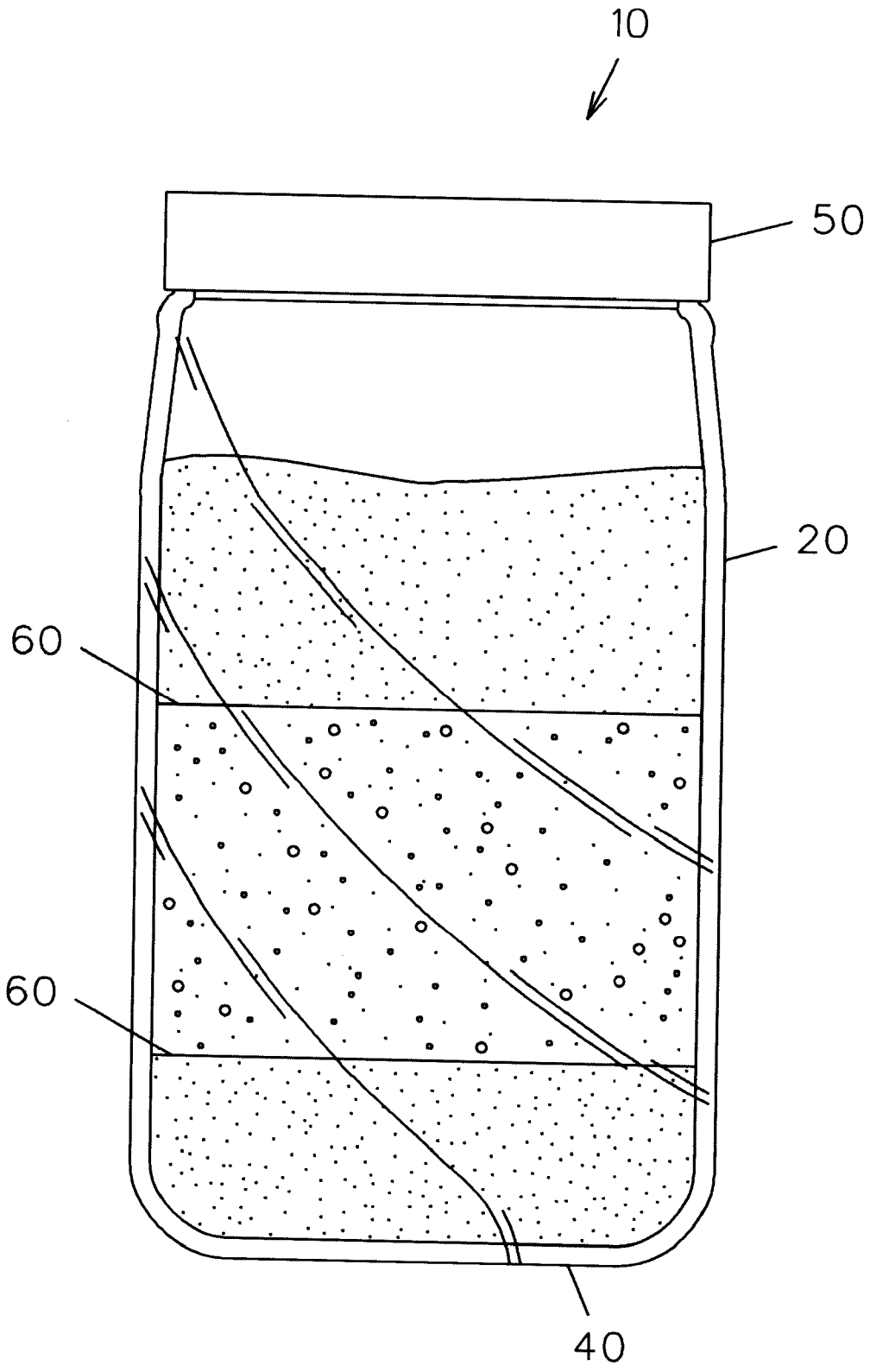
FIG. 5 is a front view of the container having three layers of food ingredients deposited therein.

Once a divider 60 is positioned atop a layer of a food ingredient, pressure is applied thereto so as to form a level surface atop the food ingredient as well as to flatten out the divider 60. It is understood that the pressure applied to a divider may come from the extension of a commercial tool into the container 10, by a user's fingers, or merely by deposition of the next dry ingredient thereon. In flattening the upwardly extending peripheral edges 70 of a divider 60, the edges 70 bear against and frictionally adhere to the interior surface of the container side wall 20. This effectively forms a seal between adjacent layers of food ingredients. The steps of depositing a food ingredient into the container 10 and tightly positioning a divider 60 thereon are repeated until all of the dry ingredients for a desired food product have been deposited. No divider 60 is placed upon the final dry ingredient. The lid 50 can be threadably secured to the container 10 when all of the ingredients are in place in order to maintain freshness thereof (FIG. 5). A recipe corresponding to the dry ingredients in the container may be included on a label attached to the container 10 or printed on a card or booklet positioned within the interior of the container 10.

Figure 6:
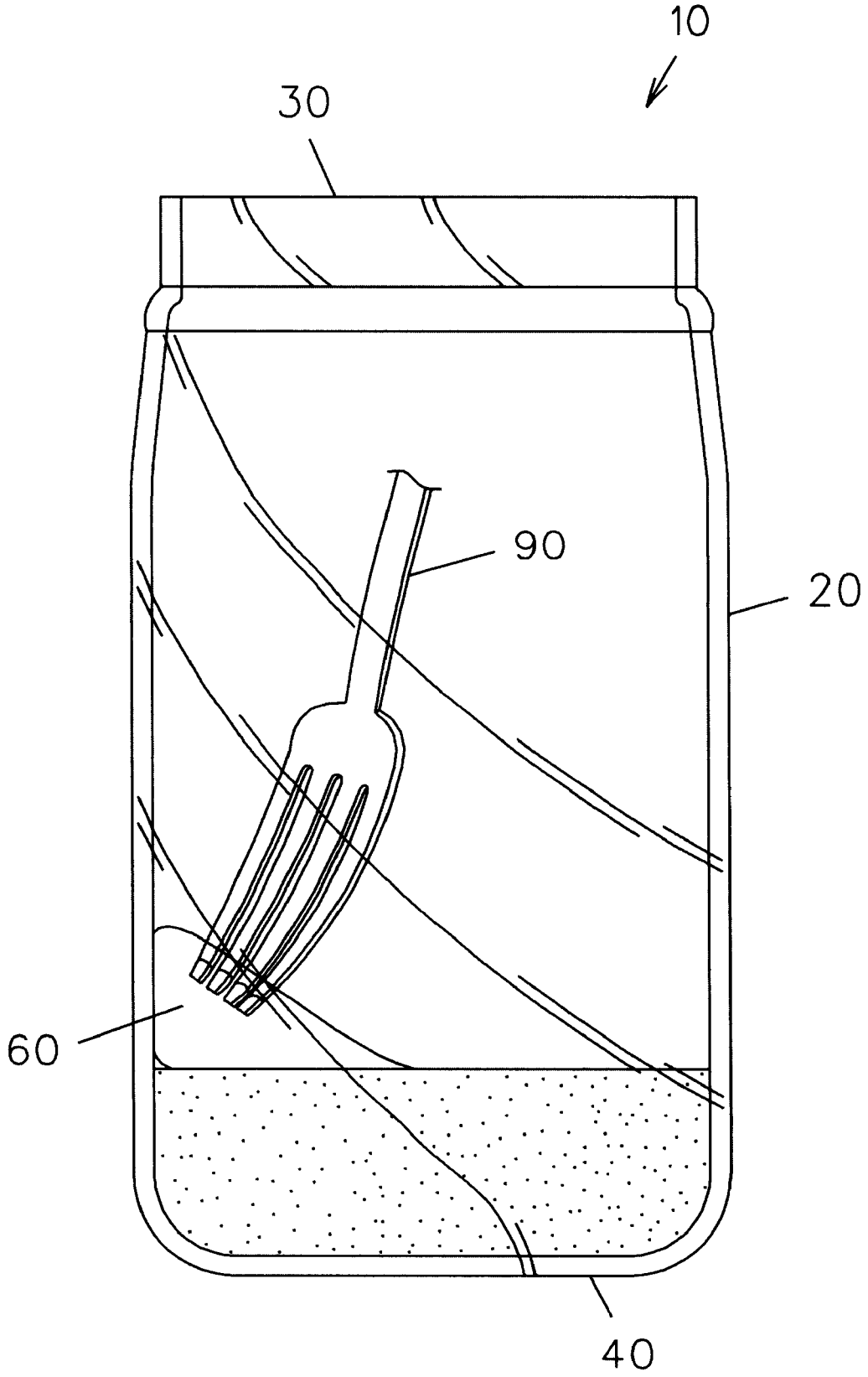
FIG. 6 is a front view of the container as in FIG. 2 with a divider being removed with a fork.

A consumer may prepare the final food product by sequentially removing the dry food ingredients from the filled container 10, combining them with the appropriate wet ingredients according to the recipe. More particularly, the lid is removed from the container 10 and the container 10 is inverted. This inversion allows the uppermost ingredient to be deposited out of the container 10 through the open top 30. It should be appreciated that the dividers 60 which separate the food ingredients and are frictionally secured within the container 10 prevent the remaining ingredients from simultaneously flowing therefrom. As desired, each remaining dry food ingredient may unitarily be removed by positioning the container 10 in an upright position, removing the now uppermost divider 60, and then re-inverting the container 10. A divider 60 may be removed by piercing it with a sharp instrument such as a fork 90 and then lifting it upward through the open top 30 (FIG. 6). The dividers are disposable. Upon inversion, the now uppermost food ingredient is deposited through the open top 30, and so on.

It should be appreciated that the selective removal process described above enables a consumer to easily separate desired and undesired dry ingredients during removal. This is important where a consumer has a health concern which dictates that certain ingredients not be consumed. This removal process further enables the dry ingredients to be combined with wet ingredients in a particular order rather than all at once, as may be indicated by the selected recipe.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A process for filling and using a layered multi-component container of food ingredients for the preparation of a food product, comprising the steps of:

(a) providing a container having a cylindrical side wall and an open top adapted to provide access to the interior of said container;

(b) introducing a dry food ingredient into said container through said open top;

(c) positioning a semi-flexible disk-shaped divider atop said dry food ingredient, said divider having a concave configuration with a diameter larger than a diameter of said container for sweeping the sides of said container upon insertion and removal relative to said container, said divider having a plurality of pleats extending radially about a top surface thereof such that said divider is adapted to collapse inwardly upon insertion into said container and to form a flattened configuration in a sealing relationship relative to a periphery of said container when pressure is applied to said divider;

(d) introducing another dry food ingredient into said container through said open top, said another dry food ingredient applying pressure to said divider for forming a level top surface on said dry food ingredient downwardly adjacent to said another dry food ingredient and sealing said another dry food ingredient from said downwardly adjacent dry food ingredient;

(e) repeating steps (c)–(d) until all of the dry food ingredients needed for the preparation of a selected food product have been introduced into said container;

(f) placing said container in an inverted position such that the dry food ingredient immediately adjacent said open top is deposited therethrough;

(g) placing said container in an upright position;

(h) removing a respective divider positioned atop the next adjacent dry food ingredient in said container by piercing said divider with a fork and lifting it upward through said open top of said container; and (i) repeating steps (f)–(h) until each dry food ingredient is deposited from said container.

2. A process as in claim 1 further comprising the step of selectively combining said deposited dry food ingredients with wet food ingredients according to a selected recipe for making a final food product.

3. A process as in claim 1 further comprising the step of placing a lid on said container after all of said dry food ingredients needed for the preparation of a selected food product have been introduced into said container.

4. A process as in claim 1 wherein said container is constructed of a transparent material; and each said divider is constructed of a transparent material.

* * * * *